US005622512A

United States Patent [19]

Uchida et al.

[11] Patent Number: 5,622,512

[45] Date of Patent: Apr. 22, 1997

[54] APPARATUS FOR FORMING WATERPROOF CONNECTION

[75] Inventors: Yoshinori Uchida; Toshiro Maejima, both of Shizuoka, Japan

[73] Assignee: Yazaki Corporation, Tokyo, Japan

[21] Appl. No.: 430,448

[22] Filed: Apr. 14, 1995

[30] Foreign Application Priority Data

Apr. 15, 1994 [JP] Japan ..... 6-77544

[51] Int. Cl.[6] ..... H01R 13/52

[52] U.S. Cl. ..... 439/271

[58] Field of Search ..... 439/271, 272–282

[56] References Cited

U.S. PATENT DOCUMENTS 5,108,303 4/1992 Maeda et al. ..... 439/271

FOREIGN PATENT DOCUMENTS 0033031 8/1981 European Pat. Off. ..... 439/271
WO092005603 4/1992 European Pat. Off. ..... 439/271
63-162470 10/1988 Japan .
1-117078 8/1989 Japan .

*Primary Examiner*—Neil Abrams
*Assistant Examiner*—Eugene G. Byrd
*Attorney, Agent, or Firm*—Morgan, Lewis and Bockius LLP

[57] ABSTRACT

An apparatus for affixing a packing unit for a waterproof connector includes a first connector housing for receiving wires and having through-holes, and a second connector housing for connecting with the first connector housing. A packing unit is inserted in the first connector housing for providing a waterproof seal at an engaging surface between the first connector housing and the second connector housing. Projection parts are disposed respectively on opposite side portions of one end of the packing unit, each of the projection parts having an outwardly extending retaining portion for engaging the first connector housing. A rear holder is attached to a rear end of the first connector housing for retaining the packing unit, and lock portions are disposed respectively on opposite side portions of one end of the rear holder. Lock pawls, for respectively retaining the lock portions, are disposed adjacent to outlets of the through-holes formed in the first connector housing, respectively.

16 Claims, 4 Drawing Sheets

1
2
2a
3
4
4a
5
5a
5b
6
6a
7
7a
8
11
W
Z

APPARATUS FOR FORMING WATERPROOF CONNECTION

BACKGROUND OF THE INVENTION

1. The Field of the Invention

This invention relates to a waterproof connector, and more particularly, to a waterproof connector and related method using a packing or sealing material. While the invention is subject to a wide range of applications, it is especially suited for connecting a wire harness in an automobile.

2. Discussion of the Related Art

A conventional waterproof connector is described with reference to FIGS. 6 and 7, which show a waterproof connector 20. An electrical connection is made by connecting a male connector housing 21 and a female connector housing 22 together, as shown in FIG. 6. To prevent liquid, such as water, from entering the connector 20 through connected areas of the male and female connector housings 21 and 22, a packing or sealing material 24 is disposed in gap or gaps at the connected areas. Thus, a waterproof seal is ensured between the two connector housings (hereinafter referred to as "housing").

Each of the male and female housings 21 and 22 is injection-molded from a synthetic resin having an excellent insulating property. The packing material 24 is molded from synthetic rubber, for example, that can be easily deformed as well as being elastic.

The male housing 21 includes an inner tubular portion 21*a* having terminal receiving chambers 26 therein for respectively receiving and retaining connection terminals (not shown). A radially and outwardly extending rear wall 21*b* is disposed on the inner tubular portion 21*a* over an entire periphery thereof and an outer tubular portion 21*c* is disposed surrounding an outer periphery of the inner tubular portion 21*a*. A hood portion 22*a* of the mating (female) housing 22 fits in a space 23 that is formed between the inner tubular portion 21*a* and the outer tubular portion 21*c*.

As shown in FIG. 7, each packing material 24 has a retaining projection part 24*f* at one end, which is inserted in a respective through-hole 21*g* extending through a rear wall 21*b* of the male housing 21. A head portion 24*g* extending from each retaining projection part 24*f* protrudes outward from the rear wall 21*b*, thereby securely fixing the packing material 24 to the male housing 21. The hood portion 22*a* of the female housing 22 is fitted into position to form a seal between the fitting surfaces of the two housings 21 and 22.

However, in the above method of fitting the packing material 24 to the male housing 21, the direction of axis for connecting and disconnecting the male housing 21 and female housing 22 coincides with the fitting direction of the packing material 24. Therefore, when disengaging the two housings from each other, for example, the retaining projection part 24*f* of the packing material 24 may be withdrawn or displaced from the through-hole 21*g*. When the displacement occurs and before the male and female housings 21 and 22 can be reconnected, the packing material 24 must be re-fitted into position. This greatly reduces the efficiency of the operation.

SUMMARY OF THE INVENTION

The present invention has been made in view of the above circumstances and has as an object of overcoming the problems and disadvantages of the conventional devices.

A further object of the present invention is to provide a method and an apparatus for affixing a packing unit made of a sealing material for a waterproof connector where the packing unit is not displaced out of position when engaging and disengaging one connector housing to another connector housing.

Additional objects and advantages of the invention will be set forth in part in the description which follows and in part will be obvious from the description, or may be learned by practice of the invention. The objects and advantages of the invention may be realized and attained by means of the instrumentalities and combinations particularly pointed out in the appended claims.

To achieve the objects and in accordance with the purpose of the invention, as embodied and broadly described herein, the apparatus for affixing a packing unit for a waterproof connector of this invention comprises a first connector housing for receiving wires, the first connector housing having through-holes; a second connector housing for connecting with the first connector housing; a packing unit insertable in the first connector housing for providing a waterproof seal at an engaging surface between the first connector housing and the second connector housing; projection parts disposed respectively on opposite side portions of one end of the packing unit, each of the projection parts having an outwardly extending retaining portion for engaging the first connector housing; a rear holder attachable to a rear end of the first connector housing for retaining the packing unit; lock portions disposed respectively on opposite side portions of one end of the rear holder; and lock pawls, for respectively retaining the lock portions, disposed adjacent to outlets of the through-holes formed in the first connector housing, respectively.

In another aspect of the present invention, a method of affixing a packing unit for a waterproof connector having a first connector housing having through-holes at opposite sides, a second connector housing for connecting with the first connector housing, a packing unit having projection parts and locking pawls, and a rear holder having lock portions, comprises the steps of receiving wires in the first connector housing; inserting the packing unit in the first connector housing for providing a waterproof seal at an engaging surface between the first connector housing and the second connector housing; engaging the projection parts with the first connector housing through the through-holes, respectively; attaching the rear holder, having lock portions on opposite side portions of one end of the rear holder, to a rear end of the first connector housing for retaining the packing unit; retaining the packing unit in the first connector housing; retaining the lock portions of the rear holder engaged with the first connector housing; and connecting the second connector housing to the first connector housing.

BRIEF DESCRIPTION OF THE DRAWINGS

The accompanying drawings, which are incorporated in and constitute a part of this specification, illustrate embodiments of the invention and, together with the description, serve to explain the objects, advantages, and principles of the invention.

In the drawings.

DETAILED DESCRIPTION OF THE PREFERRED EMBODIMENTS

Figure 1:
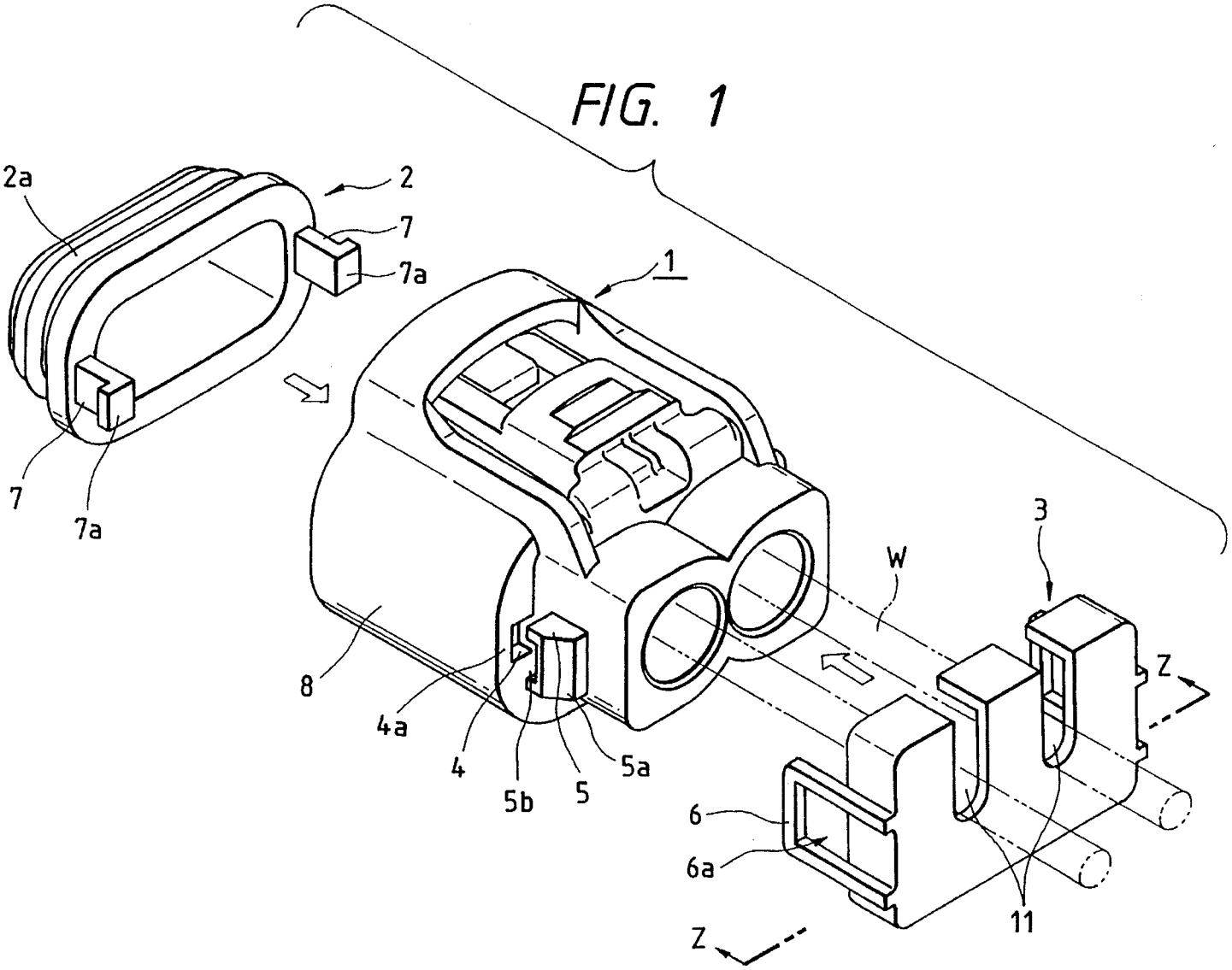
FIG. 1 is an exploded, perspective view of one preferred embodiment of a waterproof connector of the present invention.

The present invention includes a method of affixing a packing unit made of a sealing material for a waterproof connector comprising the steps of providing a connector housing having a plurality of terminal receiving chambers for respectively receiving wires, each chamber having a connection terminal connected to a front end thereof. The method includes the steps of preventing the wires from withdrawing or becoming displaced when attaching a rear holder to a rear end of the connector housing and providing an annular, tubular packing (sealing) unit in the housing for forming a waterproof seal at the surface where the connector housing is connected to a mating connector housing. The method also includes providing retaining projection parts at a front end of the annular packing unit and inserting the retaining projection parts respectively into through-holes formed in the connector housing. The method further includes providing lock portions at a front end of the rear holder and retaining the lock portions by lock pawls formed respectively adjacent to outlets of the through-holes. The retaining projection parts protrude respectively from the through-holes and are retained respectively by the lock portions of the rear holder.

The present invention also includes an apparatus for affixing a packing unit made of a sealing material for a waterproof connector, the apparatus comprising a connector housing having a plurality of terminal receiving chambers for respectively receiving wires, each chamber having a connection terminal connected to a front end thereof. A rear holder is attached to a rear end of the connector housing for preventing the wires from withdrawing or becoming displaced. An annular, tubular packing (sealing) unit is provided in the housing for forming a waterproof seal at the surface where the connector housing is connected to a mating connector housing. An L-shaped retaining projection part is disposed respectively on opposite side portions of a front end of the annular packing unit, and each retaining projection part has an outwardly extending retaining portion for retaining the engagement with the connector housing. Lock portions are disposed respectively on opposite side portions of a front end of the rear holder. Lock pawls, which respectively retain the lock portions, are disposed respectively adjacent to outlets of through-holes formed in the connector housing. When the lock portions are retained respectively by the lock pawls, the retaining projections of the annular packing unit, projecting respectively from the through-holes, are retained respectively by the lock portions.

In the preferred waterproof connector, a gap between an open end of the through-hole in the connector housing and a front end of the associated lock pawl is equal to or larger than the width of a front end portion of the lock portion of the rear holder. Also, the length of projection of the retaining portion of the annular packing unit is equal to or larger than the thickness of the lock portion. The distance between the two retaining projection parts of the annular packing unit is slightly larger than the distance between the two lock portions of the rear holder. A fitting recess for receiving the associated retaining portion of the annular packing unit is disposed at a front end of each of the lock pawls on the connector housing, and a slanting surface for slidingly contacting the associated lock portion of the rear holder is disposed on a rear end of the lock pawl.

In the preferred waterproof connector of the above construction, the L-shaped retaining projection parts are disposed respectively on the opposite side portions of the front end of the annular packing unit, each of the retaining projection parts having the retaining portion which extend outward. The lock portions are disposed respectively on the opposite side portions of the front end of the rear holder, and the lock pawls, which respectively retain the lock portions, are disposed adjacent to the outlets of the through-holes formed in the connector housing, respectively.

The annular packing unit is inserted through the front end of the housing and is projected from the through-holes. In this condition, the rear holder is attached to the rear end of the housing, so that each of the lock portions is retained by the associated lock pawl, and the rear holder also retains the associated retaining projection part of the annular packing unit projecting from the associated through-hole.

Thus, the retaining projection parts are retained respectively by the lock portions of the rear holder attached in a direction opposite to the direction the packing unit is affixed. Therefore, the packing unit is prevented from being displaced out of position or disengaged when the housing is disconnected from the mating housing.

Figure 2:
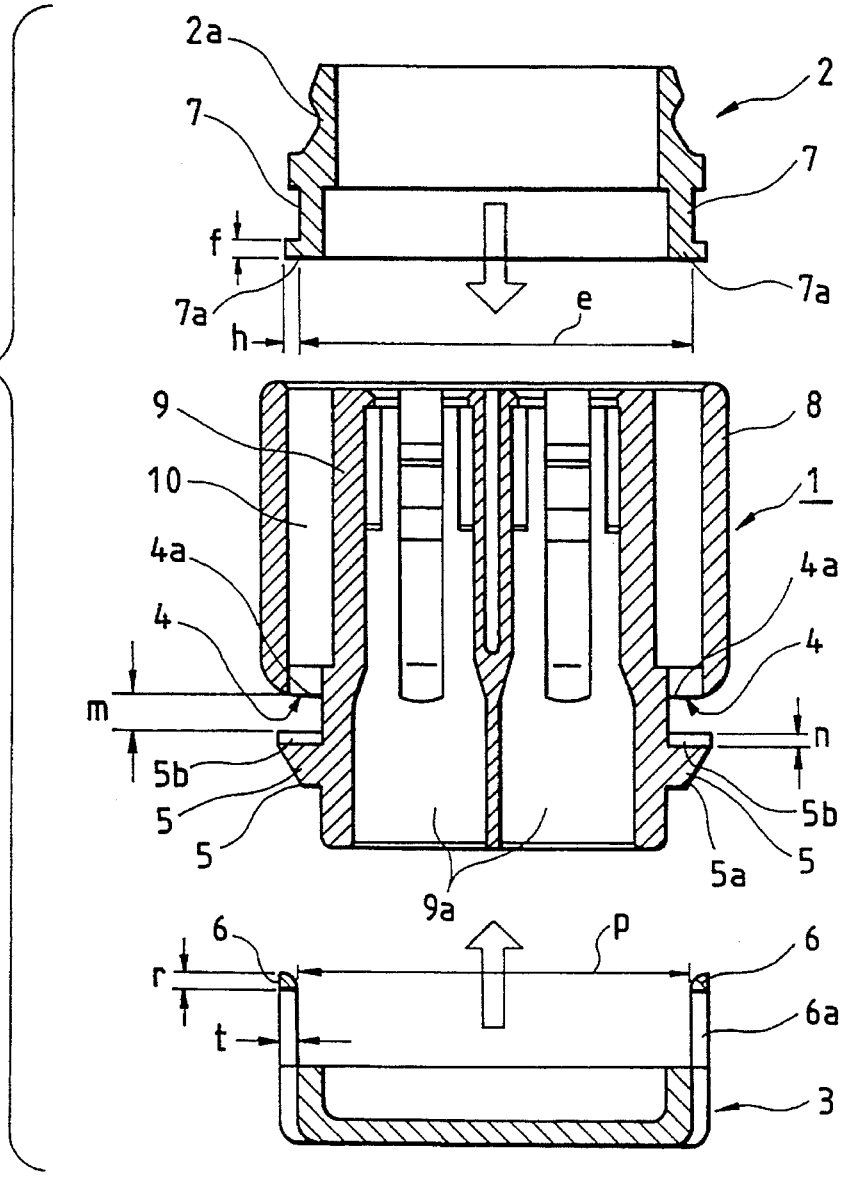
FIG. 2 is a cross-sectional view taken along the line Z—Z of FIG. 1.
Figure 3:
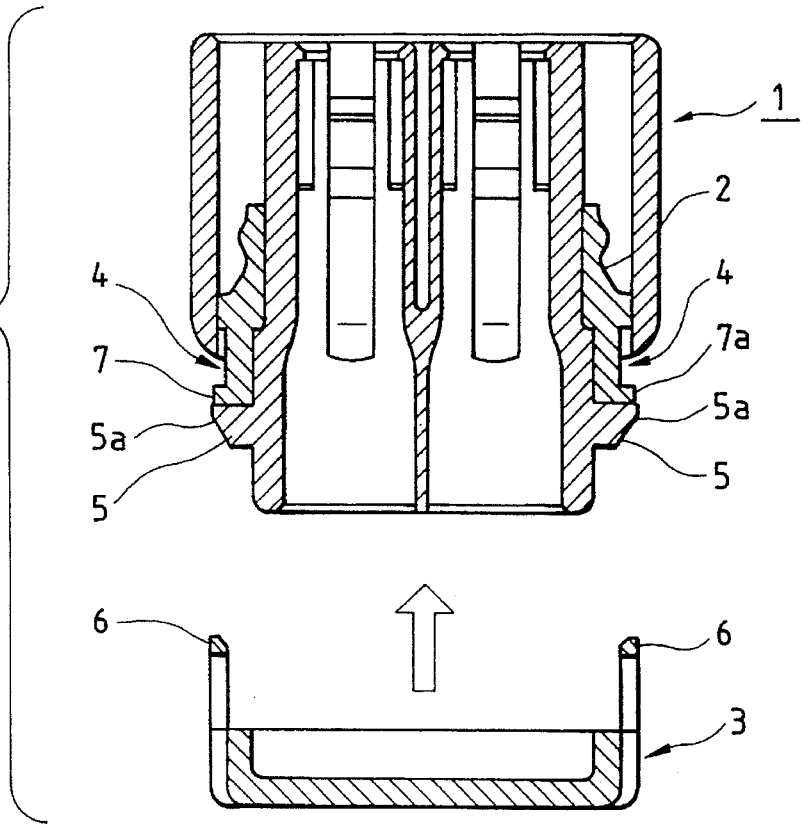
FIG. 3 is a cross-sectional view of the connector of the present invention with a packing unit fitted in position.
Figure 4:
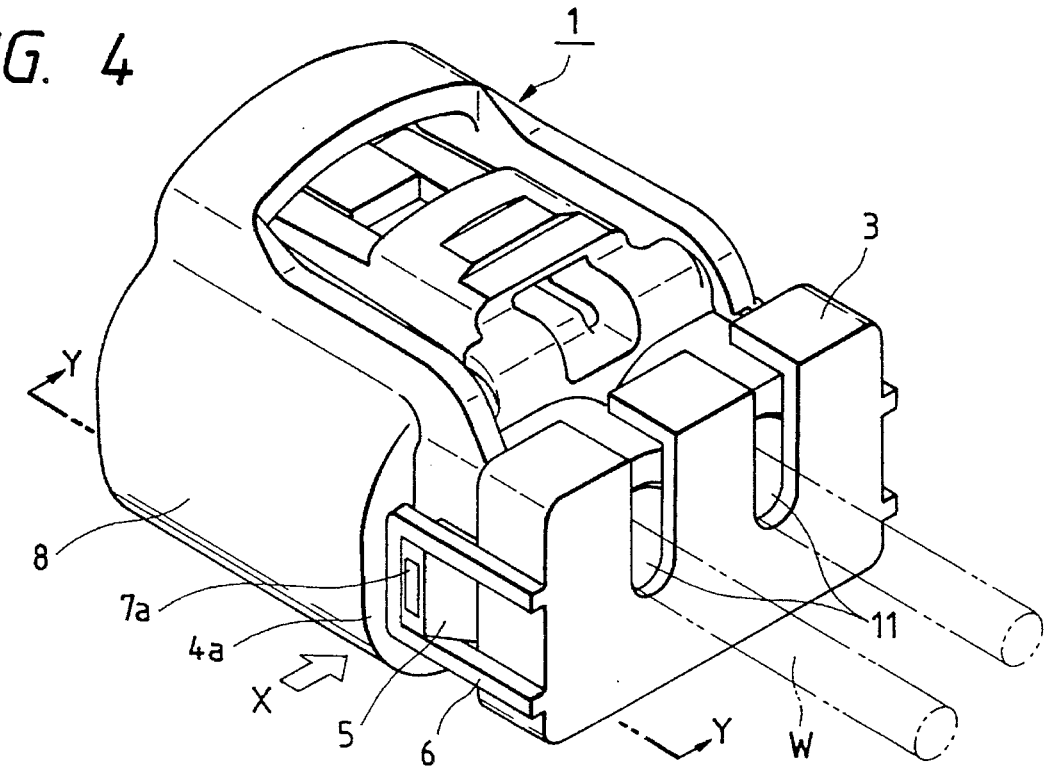
FIG. 4 is a perspective view of the connector of the present invention having a rear holder attached thereto.
Figure 5:
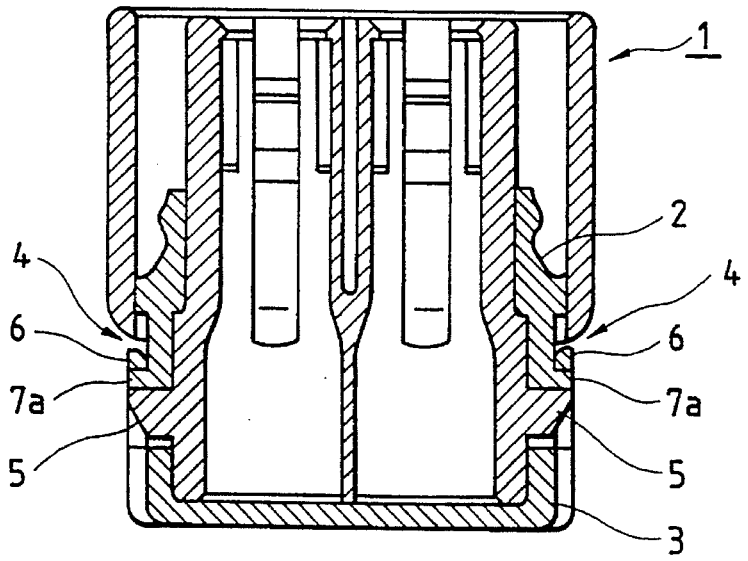
FIG. 5 is a cross-sectional view taken along the line Y—Y of FIG. 4.
Figure 6:
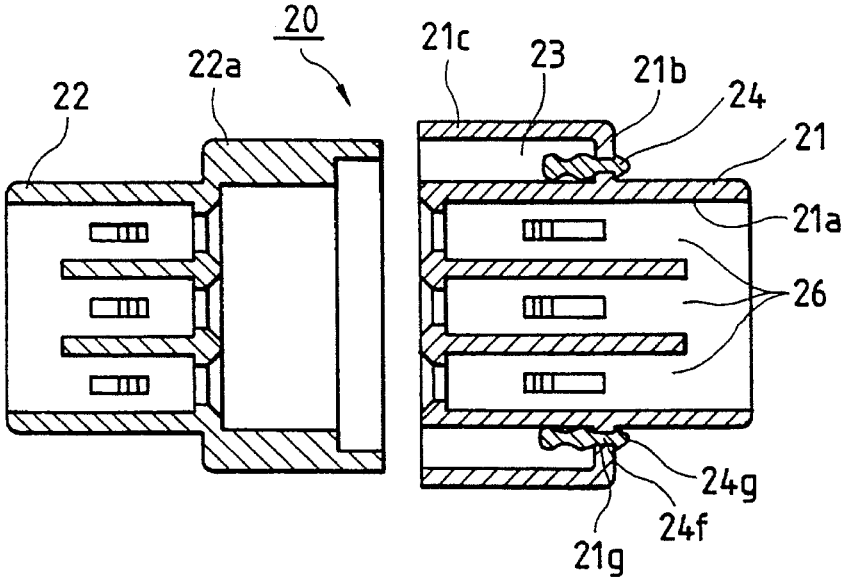
FIG. 6 PRIOR ART
FIG. 6 is a cross-sectional view showing conventional male and female housings before being fitted together.
Figure 7:
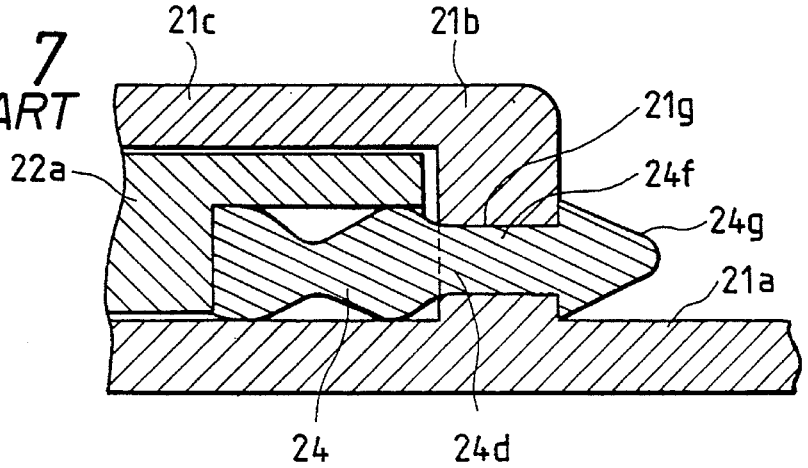
FIG. 7 PRIOR ART
FIG. 7 is an enlarged, cross-sectional view of a portion of the construction of FIG. 6.

The preferred embodiments of the present invention will now be described with reference to FIGS. 1 to 5. FIG. 1 is an exploded, perspective view of one preferred embodiment of the waterproof connector of the present invention. FIG. 2 is a cross-sectional view taken along the line Z—Z of FIG. 1, and FIG. 3 is a cross-sectional view of the connector of the present invention having a packing unit fitted in position. FIG. 4 is a perspective view of the connector of the present invention having a rear holder attached thereto, and FIG. 5 is a cross-sectional view taken along the line Y—Y of FIG. 4.

As shown in FIGS. 1 and 2, the waterproof connector of the present invention includes a male housing 1 for receiving connection terminals. An annular packing unit 2, which is inserted into the male housing 1 through a front end, fits on a surface where the male housing 1 and a mating (female) housing is connected. A rear holder 3 is attached to the rear end of the male housing 1 to retain the connection terminals and prevent them from being withdrawn or displaced.

The male housing 1 includes an inner tubular portion 9 having terminal receiving chambers **9*a* for respectively receiving a plurality of connection terminals and an outer tubular portion 8 surrounding the inner tubular portion 9. Through-holes 4 for retaining the packing unit are formed near the outer tubular portion 8 at opposite sides. The through-holes 4 extend to a rear surface of a proximal end of the outer tubular portion 8**.

Lock pawls 5, for retaining the rear holder 3, are each spaced a distance "m" from a respective open rear end or edge **4*a* of the corresponding through-hole 4. A fitting recess 5*b* for receiving a corresponding retaining portion 7*a* of the annular packing unit 2 (described later) is disposed at each front end of the lock pawls 5. A sloping surface 5*a* for slidingly contacting a respective lock portion 6 of the rear holder 3 (described later) is disposed on a respective rear end portion of the lock pawl 5**.

The annular packing unit 2 is fitted in a space 10 between the inner tubular portion 9 and the outer tubular portion 8 to close and seal a gap between the fitting surfaces of the male and female housings when the two housings are connected together, thereby preventing water from leaking through. The annular packing unit 2 includes a tubular portion 2*a* for a tight fit with the inner tubular portion 9 of the male housing 1 and a pair of L-shaped retaining projection parts 7 disposed respectively on opposite side portions of a front end of the tubular portion 2*a*. Each of the retaining projection parts 7 has a retaining portion 7*a* extending radially outward.

When the annular packing unit 2 is fitted onto the inner tubular portion 9, with the retaining projection parts 7 extending respectively through the through-holes 4, the retaining portions 7*a* projects respectively from the open ends 4*a* to respectively engage the lock portions 6 of the rear holder 3 (described later).

The rear holder 3, which is attached to the rear end of the male housing 1, serves to prevent wires W from being displaced and to provide an easy waterproofing operation. The rear holder 3 has wire receiving grooves 11 having a U-shape. Each groove extends in a vertical direction and holds an associated wire W at a generally central portion. The lock portions 6, which are disposed respectively at opposite sides of the rear holder 3, maintain an engaged state with the male housing 1 and secure the annular packing unit 2. Each of the lock portions 6 has a shape similar to a picture frame and a central retaining opening 6*a* for receiving the lock pawl 5. The lock portions 6 extend in the direction of attachment of the rear holder.

The operation of attaching the annular packing unit 2 and the rear holder 3 to the male housing 1 will now be described.

The annular packing unit 2 is inserted through the front end of the male housing 1 and secured in the space 10 between the inner tubular portion 9 and the outer tubular portion 8, as shown in FIG. 2. Then, the annular packing unit 2 is further forced inward to project the retaining projection parts 7 of the annular packing unit 2 respectively from the open ends 4*a* of the through-holes 4. As shown in FIG. 3, the retaining portion 7*a* (formed at the front end of each retaining projection part 7) protrudes from the through-hole 4 and fits in the fitting recess 5*b* at the front end of the corresponding lock pawl 5 on the male housing 1.

If the mating female housing engages the male housing and then disengages, a frictional force acts on the tubular portion 2*a* of the annular packing unit 2 in the direction of disengagement. This causes the annular packing unit 2 to become displaced out of position, or disengaged completely. To avoid such displacement of the annular packing unit, a rear holder 3 is attached to the rear end of the male housing 1. In particular, the rear holder 3 is moved toward the male housing 1 and the lock portions 6 of the rear holder 3 are respectively held in sliding contact with the sloping surfaces 5*a* of the lock pawls 5.

Then, the front end of each lock portion 6 slides over its associated lock pawl 5 to a gap "m" between the open end 4*a* of the associated through-hole 4 and the front end of the lock pawl 5. Also, the lock pawl 5 and the associated retaining portion 7*a* are retainingly received in the retaining opening 6*a* of the lock portion 6, as shown in FIGS. 4 and 5.

With respect to the dimensions in the above embodiment, the gap "m" between the open end 4*a* of the through-hole 4 in the male housing 1 and the front end of the lock pawl 5 is preferably equal to or larger than a width "r" (FIG. 2) of the front end portion of the lock portion 6. Therefore, even if the entire retaining portion 7*a* of the annular packing unit 2 is not completely received in the fitting recess 5*b* (that is, a thickness "f" of the retaining portion 7*a* is larger than a depth "n" of the fitting recess 5*b*), the lock portion 6 can be retained in the gap "m" as long as the gap "m" is larger than the width "r" of the front end portion of the lock portion 6.

A length "h" of the projection of the retaining portion 7*a* of the annular packing unit 2 is preferably equal to or larger than a thickness "t" of the lock portion 6 of the rear holder 3. However, in order that the front end portion of the lock portion 6 can be smoothly retained in the gap "m," the retaining portion 7*a* preferably should not project beyond the side surface of the lock pawl 5.

A distance "e" between the two retaining projections 7 of the annular packing unit 2 is preferably slightly larger than a distance "p" between the two lock portions 6 of the rear holder 3. With this arrangement, when the rear holder 3 is attached to the male housing 1 as shown in FIG. 4, the two retaining projection parts 7 are urged toward each other (for example, in a direction X) due to the elasticity of the two lock portions 6.

As described above, in the method and apparatus for affixing a packing unit for a waterproof connector according to the present invention, when the retaining projection parts at the front end of the annular packing unit are inserted respectively into the through-holes in the housing and the lock portions at the front end of the rear holder are retained respectively by the lock pawls respectively provided adjacent to the outlets of the through-holes, the retaining projection parts of the packing unit, which project respectively from the through-holes, are retained by the lock portions of the rear holder, respectively.

Thus, in the connected or fitted configuration of the housing, the retaining projection parts of the annular packing unit are retained respectively by the lock portions of the rear holder attached in the direction opposite to the engaging direction of the packing unit. Also, the retaining projection parts are urged toward each other due to the elasticity of the lock portions.

As a result, a force for retaining the packing unit is greatly increased and the packing unit is prevented from being displaced out of position or disengaged when the male and female housings are disconnected from each other.

The foregoing description of the preferred embodiments of the invention has been presented for purposes of illustration and description. It is not intended to be exhaustive or to limit the invention to the precise form disclosed, and modifications and variations are possible in light of the above teachings or may be acquired from practice of the invention. For example, although the embodiment of the present invention is described using an annular packing unit, the packing unit may have numerous other shapes consistent with the invention. The embodiments were chosen and described in order to explain the principles of the invention and its practical application to enable one skilled in the art to utilize the invention in various embodiments and with various modifications as are suited to the particular use contemplated. It is intended that the scope of the invention be defined by the claims appended hereto, and their equivalents.

What is claimed is:

1. An apparatus for forming a waterproof connection, the apparatus comprising:

a first connector housing for receiving wires, the first connector housing defining through-holes;

a second connector housing for connecting with the first connector housing;

a packing unit insertable in the first connector housing for providing a waterproof seal between an engaging surface of the first connector housing and an engaging surface of the second connector housing;

projection parts included respectively on opposite side portions of one end of the packing unit, wherein each of the projection parts includes an outwardly extending retaining portion for engaging the first connector housing, and wherein each of the retaining portions project through respective through-holes;

a rear holder attachable to a rear end of the first connector housing for retaining the packing unit;

lock portions disposed respectively on opposite side portions of one end of the rear holder; and lock pawls, for respectively retaining the lock portions, disposed adjacent to outlets of the through-holes defined by the first connector housing, respectively.

2. An apparatus according to claim 1, wherein the retaining portions are retained by respective lock portions when the lock portions are retained by respective lock pawls.

3. The apparatus according to claim 1, wherein an open end of one of the through-holes defined by the first connector housing and a front end of an associated one of the lock pawls define a gap therebetween, the gap being approximately equal to or larger than a width of a front end portion of the lock portion of the rear holder.

4. The apparatus according to claim 1, wherein the retaining portion of the packing unit has a length of projection approximately equal to or larger than a thickness of the lock portion.

5. The apparatus according to claim 1, wherein a distance between the projection parts of the packing unit is larger than a distance between the lock portions of the rear holder.

6. The apparatus according to claim 1, wherein the first connector housing includes a plurality of chambers for receiving the wires and having a connection terminal connected to a front end of the chambers.

7. The apparatus according to claim 1, wherein the first connector housing includes an outer tubular portion and an inner tubular portion, the outer and inner tubular portions defining a space therebetween, and the packing unit being positioned in the space.

8. The apparatus according to claim 1, wherein the packing unit is made of a sealing material.

9. The apparatus according to claim 1, wherein the packing unit is an annular, tubular packing unit.

10. The apparatus according to claim 1, further comprising:

fitting recesses for receiving corresponding ones of the retaining portions of the packing unit, each of the fitting recesses being disposed at a front end of each of the lock pawls on the first connector housing, respectively; and sloping surfaces for contacting corresponding ones of the lock portions of the rear holder, each of the sloping surfaces being disposed on a rear end of a corresponding one of the lock pawls.

11. The apparatus according to claim 1, wherein the packing unit is securely fixed to the first connecting housing when the rear holder is engaged with the first connecting housing through the lock portions.

12. The apparatus according to claim 11, wherein the packing unit is maintained in a fixed position in the first connector when the first connector is disengaged with the second connector.

13. The apparatus according to claim 1, wherein the rear holder includes grooves for holding the wires and preventing the wires from being displaced.

14. The apparatus according to claim 1, wherein the projection parts have an L-shape.

15. An apparatus for forming a waterproof connection, the apparatus comprising:

a first connector housing for receiving wires, the first connector housing defining through-holes;

a second connector housing for connecting with the first connector housing;

a packing unit inserted in the first connector housing for providing a waterproof seal between an engaging surface of the first connector housing and an engaging surface of the second connector housing;

projection parts included respectively on opposite side portions of one end of the packing unit, wherein each of the projection parts includes an outwardly extending retaining portion for engaging the first connector housing, and wherein each of the retaining portions project through respective through-holes;

a rear holder attachable to a rear end of the first connector housing for retaining the packing unit;

lock portions disposed respectively on opposite side portions of one end of the rear holder; and lock pawls for respectively retaining the lock portions and disposed adjacent to outlets of the through-holes defined by the first connector housing, respectively.

16. An apparatus according to claim 1, wherein the lock pawls include fitting recesses for receiving the projecting portions.

* * * * *